United States Patent [19]

Sale

[11] 4,128,751

[45] Dec. 5, 1978

[54] MICROWAVE HEATING OF FOODS

[75] Inventor: Anthony J. H. Sale, Sharnbrook, England

[73] Assignee: Lever Brothers Company, New York, N.Y.

[21] Appl. No.: 785,274

[22] Filed: Apr. 6, 1977

[30] Foreign Application Priority Data

Apr. 8, 1976 [GB] United Kingdom ..... 14374/76

[51] Int. Cl.[2] ..... H05B 9/06

[52] U.S. Cl. ..... 219/10.55 A; 426/243

[58] Field of Search ..... 219/10.55 A, 10.55 F, 219/10.55 R, 10.55 M; 426/234, 237, 241, 243

[56] References Cited

U.S. PATENT DOCUMENTS

| | | | |
|---|---|---|---|
| 3,151,230 | 9/1964 | Britton | 219/10.55 A |
| 3,557,334 | 1/1971 | Lewis | 219/10.55 A |
| 3,564,458 | 2/1971 | Cumming | 219/10.55 A X |
| 3,715,551 | 2/1973 | Peterson | 219/10.55 A |
| 4,005,301 | 1/1977 | Thourel | 219/10.55 A |
| 4,020,311 | 4/1977 | Churchland | 219/10.55 A |
| 4,054,768 | 10/1977 | White et al. | 219/10.55 F X |

*Primary Examiner*—Arthur T. Grimley

[57] ABSTRACT

Frozen food in packs, generally of rectilinear configuration, are heated for consumption by being passed through a microwave energy field which generates heat which is substantially uniform across the pack width and which traverses the pack length due to movement relatively between the pack and microwave energy source. The relative movement overcomes thermal runaway since the energy is continuously being dragged away from the zones which have just been heated and where thermal runaway could otherwise occur.

16 Claims, 8 Drawing Figures

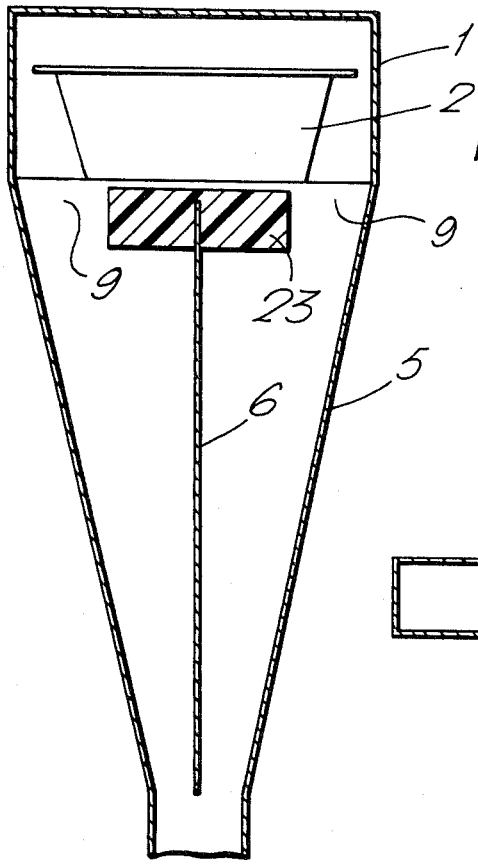
Fig. 7.
Fig. 8.
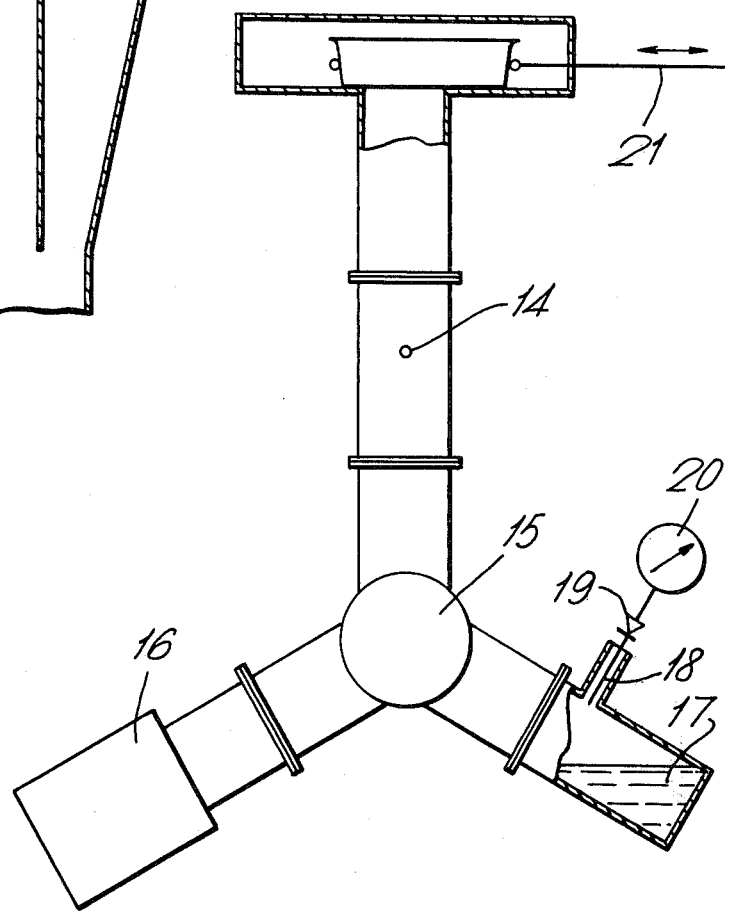

MICROWAVE HEATING OF FOODS

The present invention relates to the microwave heating of foods, particularly for the preparation for consumption of frozen pre-packed meals.

Institutionalised catering, for example factory canteens or hospital meal services, desirably require the minimum of preparation time, combined with a reasonable quality of product, a fair choice of alternatives and economy.

With these aims in mind, the use of pre-prepared frozen packs of food in conjunction with micro-wave heating has been considered; however re-heating is generally of the order of ten minutes or so and this usually constitutes an unacceptable delay, and also a wide ranging free choice is impractical. Consequently in factory canteens it is still the practice to have pre-heated quantities of food available from which to serve meals of restricted choice range and quality.

Considering the factory canteen situation, a queue of people should desirably be able to sequentially select a meal, pay for it and take it away on a tray; and in a smooth running system this should be possible in two to three minutes.

If therefore the re-heating time in a microwave oven can be reduced from ten minutes to less than three minutes, the meal becomes capable of being re-heated as the individual goes through the process of selecting and paying for it — and then there is no longer the requirement for pre-heated quantities of food being available and an improved quality and greater selection become possible.

To achieve this rapid heating would be difficult in a conventional multi-mode microwave oven because merely increasing the power accentuates the so-called thermal runaway problem. Thermal runaway is the effect which occurs when microwave energy is applied to a frozen food where, as soon as part of the frozen food thaws and changes from ice to liquid, this part assumes a greater dielectric loss factor than the remaining ice and selectively takes more of the power from the system, so distorting the energy field and resulting in uneven heating.

The present invention aims to provide a rapid heating method where the problem of thermal runaway is minimised or reduced and accordingly provides a method of heating a pack of frozen food for consumption, which pack is of substantially uniform length and uniform width, comprising effecting relative movement of the pack in its length direction past an outlet fed by a source of microwave energy, and causing said outlet to supply microwave energy to the pack under conditions such that substantially uniform heating occurs across the pack width while in the pack length direction heating is concentrated in a band which is shorter than the pack length, and which through the relative movement between the pack and said microwave outlet sequentially traverses the pack length.

The invention also provides an apparatus for heating frozen food packs for consumption comprising a microwave energy source, energy feed means for feeding energy from said source to an outlet, and conveying means for conveying a pack containing frozen food past said outlet, said outlet, said conveying means and said energy feed means being so positioned in relation to one another that substantially uniform heating occurs across the pack width while in the pack length direction heating is concentrated in a band which is shorter than the pack length.

Concentration of the length direction heating into a restricted band coupled with relative movement between pack and energy source enables a high heat input into the pack to be achieved without encountering significant thermal runaway problems.

This is because the energy source (the microwave outlet) is continuously being moved away from zones where thermal runaway would otherwise occur. Thus any distortion of the field consequent on frozen material thawing is kept at a minimum, and the only such effect is a slight dragging of the heating zone in the direction of pack movement (i.e. heating will be at a zone slightly in advance of the centre of the microwave outlet); and this dragging effect will be evened out as the heating zone sequentially traverses the whole of the pack length and each integral zone of the food pack will have received in total substantially the same amount of heating.

It will be recognised that the dragging effect will tend to cause uneven heating at the front and rear ends of the food pack. This can be overcome conveniently by either having dummy loads preceding and succeeding the pack as it progresses past the microwave outlet; or an infinite number of packs juxtaposed without any gap between the front of the first and the rear of the next (effectively an infinitely long pack) would also solve the end effect problem.

However we have found that the simplest way of avoiding overheating of the ends is by switching the microwave energy on and off in timed relationship with the pack movement. In particular the energy should be switched on as the leading edge of the pack has moved about halfway across the microwave outlet and should be switched off as the trailing edge is halfway across the microwave outlet. In practice owing to slight field distortion switch on should be just after the halfway point and switch off just before the relevant edge reaches halfway.

As an alternative to choosing the correct time of switching on and off, which will be effected when a unidirectional single pass takes place, if the pack is to be moved back and forth across the microwave outlet overheating of the ends can be avoided by moving the pack back and forth over a restricted pathway, i.e. by reversing the movement just before a complete pass has taken place.

In order to ensure that the total quantity of heat received at different points along the length of the pack is uniform, as well as taking into account the end effect problems referred to above, two other requirements have to be substantially met. The first of these is that the movement past the microwave outlet should be at a predetermined rate, and the second is that the food to be heated should be suitably distributed within the pack in relation to its energy absorbing properties.

Speed of movement and distribution of food within the pack are, of course, related functions, and while in practice constant speed and even distribution are the most convenient ways of achieving even heating, other corelated values of these two functions are theoretically also possible (for example if a portion of food near the centre of the pack needs more heat, the speed of movement could be slowed down at that stage).

The manner in which the food is arranged within the pack to ensure even heating is generally based on trial and error and experience. For example dense high water content foods, e.g. spinach puree, absorb more energy than lower water content particulate foods, e.g. peas; and non-uniform geometric shapes such as lamb cutlets create similar problems. It then becomes a matter of arranging such materials within the pack in such a way that the effective absorption properties are as uniform as possible.

As previously stated heating in the pack length direction is concentrated in a band which is shorter than the pack length. Generally the intensity of heating in this direction will increase to and then recede from a peak of intensity sinusoidally within a distance which may be a third to a half of the pack length, when a pack of usually encountered dimensions is used (see example to be described later).

However in the pack width direction heating should be substantially uniform. This is preferably achieved by radiation of microwave energy in single mode with the Electric Field polarised in the direction of the pack width from an outlet of substantially the same width as that of the pack. While this is the preferred method, other methods of achieving equal heating across the pack width are also possible such as by use of the equipment described in my U.S. Pat. No. 3,110,794.

With the single mode arrangement where the Electric Field is polarised in the direction of the pack width the intensity of the effective Electric Field will theoretically be substantially constant across the transverse width of the pack; while intensity will increase sinusoidally to a peak and then similarly subside in the direction of movement.

In regard to the width direction, a single rectangular waveguide outlet using the most commonly used frequency, i.e. 2450 MHz, would only encompass a particularly narrow pack width i.e. about 5 cm. Therefore to achieve a pack width which is commercially more acceptable, we have found it desirable to substantially double the waveguide outlet width by using an applicator in the form of a Y type power divider supplied from a single power source. The same effect could be achieved by using two waveguide outlets next to each other, combined with other known power dividers, and greater multiples are also possible.

As a further measure to improve the uniformity of heating across the width of the food pack we have found that when heating certain particularly dense, high water content, foods steps need to be taken to prevent overheating at the side edges of such a pack. By guiding the microwave energy via a pair of slots one at each side of the applicator and corresponding to the edges of the pack, greater uniformity can be achieved provided these slots are spaced half a wavelength apart. This provides, in effect, two in phase sources spaced half a wavelength apart.

The effect then is that in the region of each slot there will be a degree of cancellation due to out of phase power from the opposite slot reducing the power intensity, while midway between the two slots, the powers from the two slots are in phase and will re-inforce one another. These slots can for example be achieved by use of a thin conductive baffle plate parallel to and spaced from the pack base and closing the central zone of the outlet of the Y-type power divider.

Alternatively it is possible to use a dielectric insert disposed in the waveguide outlet adjacent and generally parallel to the food pack path, and of low loss factor and of a greater relative permittivity than air, which can vary the matching to the food pack and thereby be utilised to improve the uniformity of heating across the pack width. The shape and disposition of such a low-loss baffle can then be chosen to tailor the intensity of heating as desired.

From the foregoing, it will be apparent that in the preferred arrangements a substantially rectangular parallelopiped shaped pack will be used of which the width dimension is selected in relation to the waveguide outlet width, while pack length — though not critical — should be taken into acoount in arranging for a switching sequence or reciprocal movement to overcome leading and lagging edge end effects.

The third dimension of the pack, i.e. height, needs to be restricted to take into account the energy transmission capability of the microwave source. If height is too great the top of the pack would not receive adequate energy, but there is no minimum requirement.

An additional factor limiting pack height comes in when considering the method of conveying the pack and of screening the system to prevent radiation outwards from the equipment to provide adequate safety. Conveniently the radiating outlet for the microwave source opens into a screened rectangular cross-section tunnel along which the pack is caused to move. This arrangement will generally be T-shaped.

In order to inhibit propagation of radiation, when this is polarised with its field horizontal, from travelling along the upper horizontal limbs of the T (the pack pathway), these limbs should be less than half a wavelength in height. This then puts a similar limitation on the height of the pack — i.e. since the pack has to pass along within these upper limbs it must also be less than half a wavelength high.

An embodiment of the invention will now be described by way of example with reference to the accompanying diagrammatic drawings in which FIG. 1 is a perspective view part cut away of a pack heating device;

FIG. 2 is a side view showing the form of the Electric Field;

FIG. 3 shown the field disposition pictorially;

FIGS. 6 and 7 show similar views to FIG. 5 with different forms of field compensating device; and FIG. 8 shows an overall view of the microwave system layout.

Figure 1:
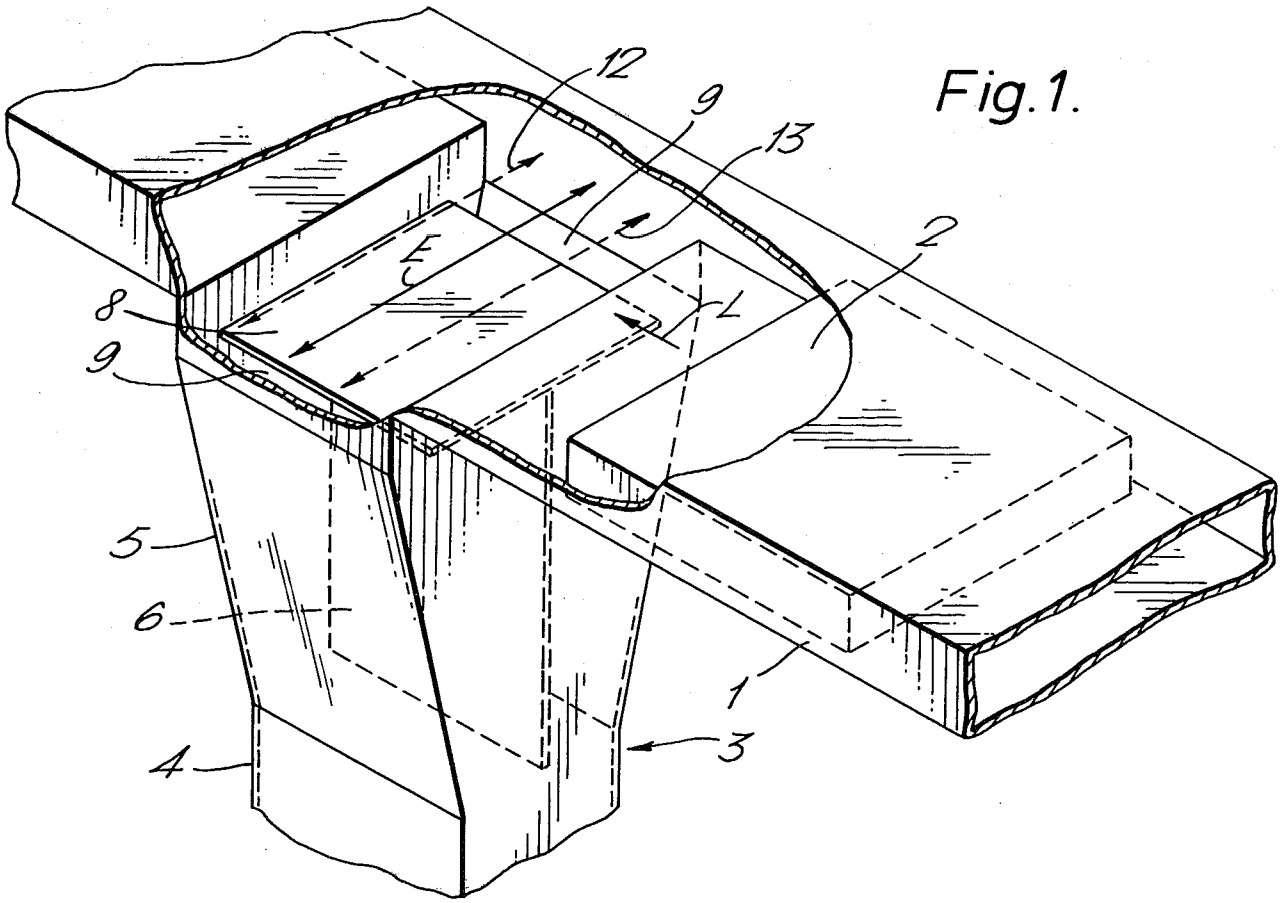

Referring to FIG. 1, a conveyor system (shown only schematically) includes a horizontal metal screening guide channel 1 for conveying a food pack 2 past a microwave applicator and vertically disposed waveguide 3. Other dispositions than horizontal and vertical are of course also feasible, but are less convenient.

Figure 2:
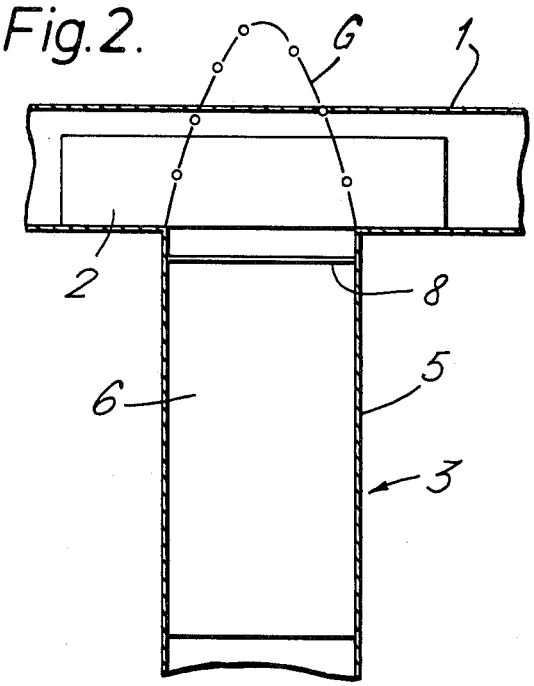

The microwave applicator and waveguide is located so that the Electric Field (E) is at right angles to the longitudinal conveying direction L and is as uniform as possible across a horizontal plane in the E direction shown. In the conveyor direction however the intensity rises to a peak and then falls again as shown by graph G (FIG. 2). The height of the guide channel 1 is less than half a wavelength long so as to inhibit transmission of horizontally polarised radiation along this channel.

Figure 3:
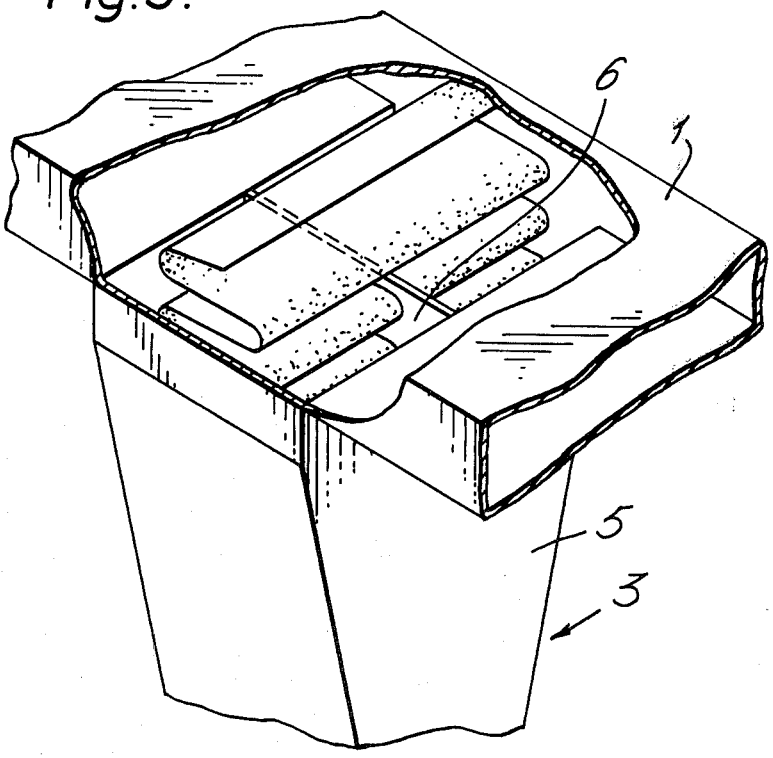
Figure 4:
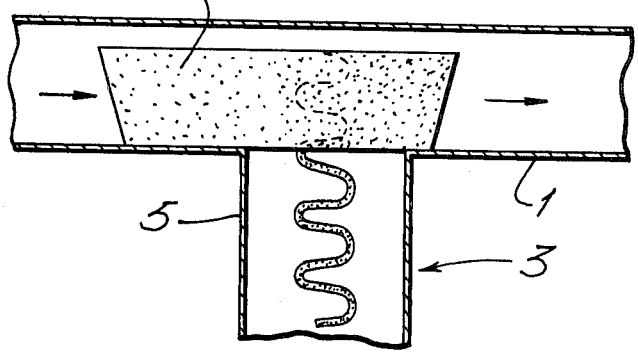
FIG. 4 shows the sequential heating effect on a pack.

The microwave applicator and waveguide 3 consists essentially of a rectangular waveguide 4 of standard internal dimensions (86 mm × 43 mm) feeding into a flared outlet section 4 and fed from a magnetron supply. Within the outlet section 5 is a conductive divider plate 6 (shown dotted) attached at each end to the side walls within the section 5. The dimensions and arrangement within the flared outlet thus form a Y type divider, giving rise to a widened zone of constant Electric Field in the direction transverse to the conveyor direction (in fact two outputs in phase which consequently behave as one), which corresponds to the pack width (see FIG. 3).

Conveniently the outlet width may be about 115 mm, instead of 43 mm of the standard waveguide, and a pack of 110 mm width may be accommodated; and the equipment is fabricated from thin conductive sheeting, for example aluminium sheeting about 1 mm thick. The depth of the channel 1 and the height of the food pack should be less than half a wavelength, e.g. about 55 mm and 35 mm respectively.

Figure 5:
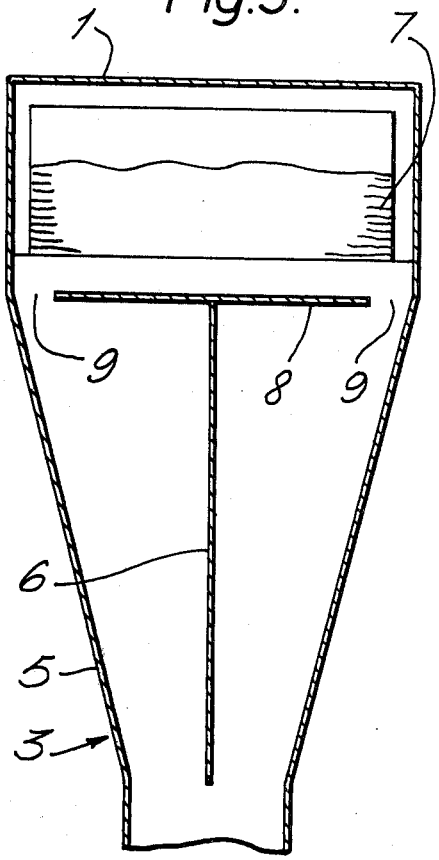
FIG. 5 shows an end view of the waveguide outlet with one form of field compensating device.

While theoretically a Y type power divider, per se, gives a constant intensity field in the transverse direction, in use some edge over-heating would tend to occur with certain dense, high water content foods, e.g. spinach puree, at edge zones 7 (see FIG. 5).

Referring to FIG. 5, one method of overcoming this problem is by provision of a baffle plate 8 attached to the top of the divider plate and to the opposing parallel walls of the flare 5 and spaced from the path of the pack base, so as to leave a slot 9 at each end, corresponding to the edge zones 7 of the food pack which would otherwise be overheated.

The centres of the two slots 9 are spaced apart by a distance equal to approximately a half wavelength of the generated energy. Then, in use, there will be a degree of cancellation at each of the edges, which thus reduces the heating at zones 7, while the two slot sources will augment one another in a central zone.

Figure 6:
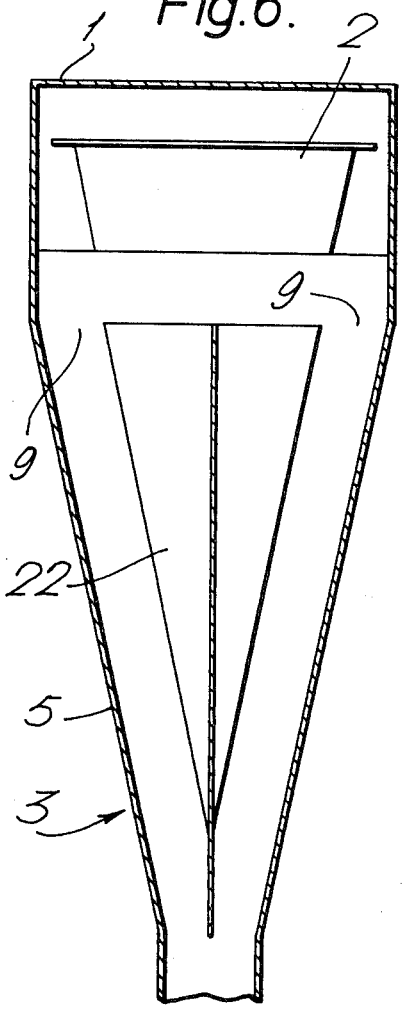

FIG. 6 shows an alternative version where the divider plate 6 and transverse plate 8 are replaced by a wedge 22, performing a basically similar function in the same manner.

FIG. 7 shows another version where the plate 8 is replaced by a block 23 of polypropylene 2 cm deep which equalised the transverse field in a different manner. This provided the most uniform and efficient transfer of power in the width direction.

Since the polypropylene is a low loss material having low loss factor and a higher relative permittivity than the equivalent volume of air (about 2.2 times), it affects the matching of power into the pack. Thus by selecting its depth, shape and location the power into the pack can be tailored to provide the required uniformity. Moreover power can be transferred to the pack more effectively with less reflection back down the waveguide. This method of matching is also to be preferred over the previously discussed horizontal baffle system since it can also be used with higher multiples of flared outlet than the double outlet previously described.

In practice food packs containing 176 gm of frozen food and measuring 110 mm × 140 mm × 35 mm were fed past the applicator and were heated from the deep frozen state (about −20° C.) to a temperature for consumption in less than three minutes. A substantially uniform heating with the absence or minimum of thermal runaway was observed. The system was coupled to a magnetron giving a nominal 2 Kilowatts output power via a conventional matching device which produces an effective power transfer of about 1½ kW into the foodpack.

The overall set up of the microwave system is shown schematically in FIG. 8. The applicator is connected to a wave guide section containing an adjustable stub 14 for matching. The next section is a circulator 15 (with three ports); one port is connected to the magnetron; the second port goes to the flared outlet applicator and the third port is connected to a water load 17, incorporating a probe 18 connected to a crystal detector 19 and a microammeter 20. The circulator directs all the power from the magnetron forward to the applicator, and also diverts any power reflected from the applicator into the dummy load 17, thereby protecting the magnetron. The crystal detector monitors the reflected power which is minimised by adjustment of the matching stub. An oscillatory feeding mechanism 21 is provided.

Setting up the matching is a compromise. There is a big difference between the impedance of the food material in the frozen and thawed conditions, but the fully frozen condition lasts such a short time that it is preferred to set up the matching for the unfrozen condition. In the unfrozen condition the match varies somewhat with the type of food and, to a small extent, with its temperature. We have found by experience that a satisfactory compromise is to adjust the matching stub to give minimum reflected power (crystal current) when 200 ml of water in a carton of the size referred to above is stationary and centrally over the flare. Under this condition the effective microwave power was measured by recording the temperature rise of the water in 20 seconds. (At perfect match — zero crystal current — 1.6 to 1.7 kW was obtained from the microwave power pack in use.)

Overheating of the end edges of the pack can occur due to the field lagging as the pack enters the heating zone. This was taken account of by restricting the length of oscillating travel across the waveguide outlet.

The length of the oscillating travel was investigated by observing the heating pattern as the length was altered. When the travel was too short the leading and trailing edges were too cold, and when too long the edges were overheated. The optimum travel was 3½ cm either side of the central position, i.e. a total travel of 7 cm of the pack of which the base is 11 cm long. The points to which the ends of the pack move and then change direction to move back are indicated by the lines 12 and 13 of FIG. 1. Thus, viewing FIG. 1, an oscillating pack moves to the left until its right hand edge is at line 13 and then moves back to the right until its left hand edge is at line 12 and subsequently oscillates between these positions.

A number of different methods of operating the flare was possible. Using a single flare the best method was to move the foodpack back and forth across the flare mouth about twelve times at a speed of 150 cm per minute, the travel across the waveguide having been restricted to avoid end edge overheating, as previously discussed. Satisfactory heated packs were achieved by this method in about one minute.

For a continuous flow system it was preferable to use several spaced flares arranged sequentially in the path of the foodpack and with corresponding switching arrangements to ensure against end edge overheating. Using two flares, a food pack speed of 10 cm per minute gave a heating time of one minute from each flare, and this achieved the desired temperature. With this continuous flow operation the points for switching the pack on were similarly located to the lines 12 and 13 of FIG. 1, switch-on occurring when the leading edge reaches the line 12 and switch-off occurring when the trailing edge of the pack reaches the line 13.

Triggering of the switches can be effected in any convenient manner such as by micro-switches or light beams.

Using a single flare with a slower speed (5 cm per minute approximately) was often satisfactory to reach the desired temperature in two minutes, but with some packed products this mode of operation introduced a degree of unevenness to the heating effect.

The description is written in terms of a transmission frequency of 2450 MHz which at the present time is the normal microwave heating frequency. However it will be understood that other microwave heating frequencies are equally permissible provided the waveguide and pack geometry are adjusted in accordance with the principles previously discussed.

What is claimed is:

1. An apparatus for heating frozen food packs for consumption, said apparatus comprising a microwave energy source, a microwave energy outlet, energy feed means for feeding microwave energy from said source to said outlet, and conveying means for conveying a pack containing frozen food past said outlet, the movement of said conveying means being in a direction at right angles to the direction of propagation from said microwave energy outlet and also at right angles to the plane of polarisation of the Electric Field propagation.

2. Apparatus according to claim 1 in which the energy feed means is adapted to feed the energy to said outlet in a single mode of propagation.

3. Apparatus according to claim 2 including switching means for switching said microwave energy on and off, and triggering means for operating said switching means, said triggering means being actuated in response to movement of a pack by said conveying means across said energy outlet.

4. Apparatus according to claim 2 in which said energy feed means is a rectangular waveguide, and including an outlet section connecting said rectangular waveguide to said energy outlet, said outlet being flared in the direction of the plane of polarisation of the Electric Field propagation to provide an outlet width greater than the width of a standard waveguide.

5. Apparatus according to claim 4 comprising at least one longitudinal baffle located within said flared waveguide outlet section to preserve single mode propagation conditions.

6. Apparatus according to claim 5 in which said outlet section is a Y type power divider.

7. Apparatus according to claim 6 comprising a baffle located parallel to the plane of said energy outlet and defining at its edges a pair of slots spaced half a wavelength apart so that energy emerging from said slots is subject to cancellation in the region of said slots and to re-enforcement halfway therebetween.

8. Apparatus according to claim 1 comprising an oscillatory conveying means arranged to oscillate a pack across said microwave energy outlet.

9. Apparatus according to claim 1 comprising a dielectric insert having a relative permittivity greater than air and a low loss factor disposed within the outlet section.

10. Apparatus according to claim 1 in which said energy feed means comprises a metal tunnel which is less than half a wavelength high and is parallel to the plane of the microwave energy outlet.

11. A method of heating a pack of frozen food for consumption, which pack is of substantially uniform length and uniform width, comprising effecting relative movement of the pack in its length direction past an outlet fed by a source of microwave energy, and causing said outlet to supply microwave energy to the pack under conditions such that substantially uniform heating occurs across the pack width while in the pack length direction heating is concentrated in a band which is shorter than the pack length, and which through the relative movement between the pack and said microwave outlet, sequentially traverses the pack length.

12. A method according to claim 11 in which the microwave energy is propagated in single mode with the Electric Field polarised transversely to the direction of movement of the pack.

13. A method according to claim 11 in which microwave energy transmission and pack movement are corelated to ensure even generation of heat at the beginning, intermediate zones and end of the pack length.

14. A method according to claim 13 in which the pack is caused to perform an oscillatory movement back and forth across the microwave outlet, and said movement has an amplitude which ensures even generation of heat at the beginning, intermediate zones and end of the pack length.

15. A method according to claim 13 in which the pack is caused to perform a continuous movement past the microwave outlet, and the microwave source is switched on and off in timed relationship with said continuous movement to ensure even generation of heat at the beginning, intermediate zones and end of the pack length.

16. A method according to claim 11 in which the pack is caused to move within a metal tunnel less than half a wavelength high and parallel to the plane of the microwave outlet.

* * * * *